US005090275A

United States Patent [19]

McCann

[11] Patent Number: 5,090,275

[45] Date of Patent: Feb. 25, 1992

[54] RETAINER APPARATUS FOR A WRENCH UNIT

[75] Inventor: Frank McCann, Taichung Hsien, Taiwan

[73] Assignee: Chiro Tool Mfg., Corp., Taiwan

[21] Appl. No.: 731,801

[22] Filed: Jul. 17, 1991

[51] Int. Cl.[5] ..... B25B 23/16

[52] U.S. Cl. ..... 81/177.85; 279/71; 279/81; 403/322; 403/DIG. 6

[58] Field of Search ..... 81/177.85, 124.6; 279/71, 81; 403/322, 327, DIG. 6

[56] References Cited

U.S. PATENT DOCUMENTS

| | | | |
|---|---|---|---|
| 1,864,466 | 6/1932 | Pekrson | 81/177.85 |
| 2,078,631 | 4/1937 | Gagne | 81/124.6 |
| 3,747,946 | 7/1973 | Edens | 279/81 |
| 4,002,348 | 1/1977 | Johnson | 279/81 |
| 4,344,340 | 8/1982 | Erickson | 81/177.85 |
| 4,708,548 | 11/1987 | Taylor et al. | 279/81 |
| 4,775,269 | 10/1988 | Brix | 403/322 |

*Primary Examiner*—Judy J. Hartman

*Attorney, Agent, or Firm*—Woodard, Emhardt, Naughton, Moriarty & McNett

[57] ABSTRACT

A retainer apparatus is used to releasably retain a socket wrench member on the plug of the driving head of a rotary lever. The retainer apparatus includes a connecting rod, a control rod and a sleeving ring. The connecting rod has an bore formed in an end surface thereof, in which the control rod is disposed. A retaining pin is passed through the position limiting hole of the connecting rod to interconnect the sleeving ring and the control rod, so that actuation of the sleeving ring can rotate the control rod relative to the connecting rod. The control rod has a circumferential extending retaining groove which is gradually deepened from a narrow end portion to a deep end portion. A retaining ball is positioned in the narrow end portion of the retaining groove and extends through a retaining hole of the connecting rod and into one of four retaining holes of the socket wrench member, so as to retain the socket wrench member on the connecting rod. When the sleeving ring is rotated an angle of 90 degrees so as to move the retaining ball to the deep end portion of the retaining groove, the socket wrench member can be removed from the connecting rod.

2 Claims, 4 Drawing Sheets

RETAINER APPARATUS FOR A WRENCH UNIT

BACKGROUND OF THE INVENTION

1. Field of the Invention

This invention relates to a wrench unit for use in a deep, narrow space, more particularly to a retainer apparatus for releasably retaining a socket wrench member on a connecting rod which is attached to the driving head of a rotary lever.

2. Description of the Related Art

To grip and turn the head of a bolt or nut in a deep, narrow space, a wrench unit is provided with a rotary lever, a set of socket wrench members of different sizes, and an elongated connecting rod interconnecting one of the socket wrench members and the square-cross-sectioned plug of the driving head of the rotary lever. The connecting rod extends from the deep, narrow space, thus permitting the rotary lever to be operated outside of the deep, narrow space. Because the connecting rod is coupled with the socket wrench member by means of a square-cross-sectioned socket and plug joint, the socket wrench member easily separates from the connecting rod. At this time, it is difficult to take the socket wrench member from the deep, narrow space.

SUMMARY OF THE INVENTION

It is therefore the main object of this invention to provide a retainer apparatus for releasably retaining a socket wrench member on a connecting rod which is attached to the driving head of a rotary lever.

According to this invention, a retainer apparatus is used to releasably retain a socket wrench member on the plug of the driving head of a rotary lever. The retainer apparatus includes a connecting rod, a control rod and a sleeving ring. The connecting rod has an bore formed in an end surface thereof, in which the control rod is disposed. A retaining pin is passed through the position limiting hole of the connecting rod to interconnect the sleeving ring and the control rod, so that actuation of the sleeving ring can rotate the control rod relative to the connecting rod. The control rod has a circumferential extending retaining groove which is gradually deepened from a narrow end portion to a deep end portion- A retaining ball is positioned in the narrow end portion of the retaining groove and extends through a retaining hole of the connecting rod and into one of four retaining holes of the socket wrench member, so as to retain the socket wrench member on the connecting rod. When the sleeving ring is rotated an angle of 90 degrees so as to move the retaining ball to the deep end portion of the retaining groove, the socket wrench member can be removed from the connecting rod.

DESCRIPTION OF THE DRAWING

Other features and advantages of this invention will become apparent in the following detailed description of a preferred embodiment of this invention, with reference to the accompanying drawings, in which.

DETAILED DESCRIPTION OF THE PREFERRED EMBODIMENT

Figure 1:
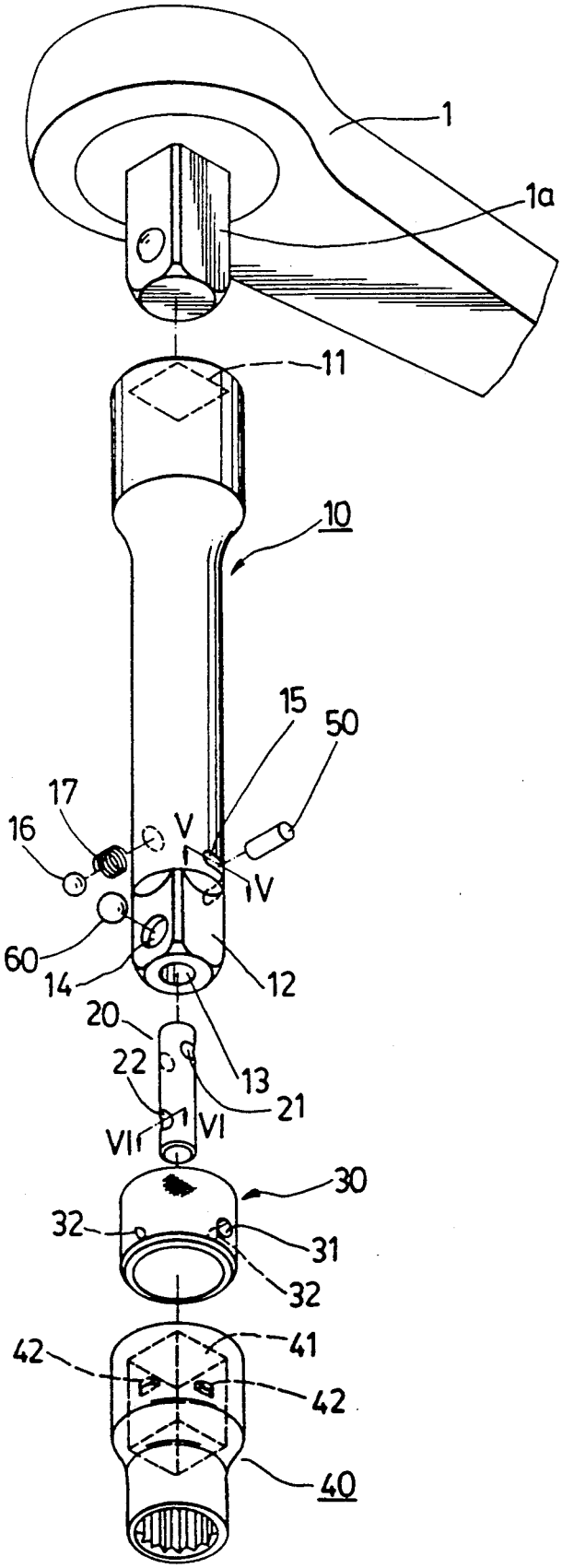
FIG. 1 is an exploded view of a retainer apparatus according to this invention.
Figure 2:
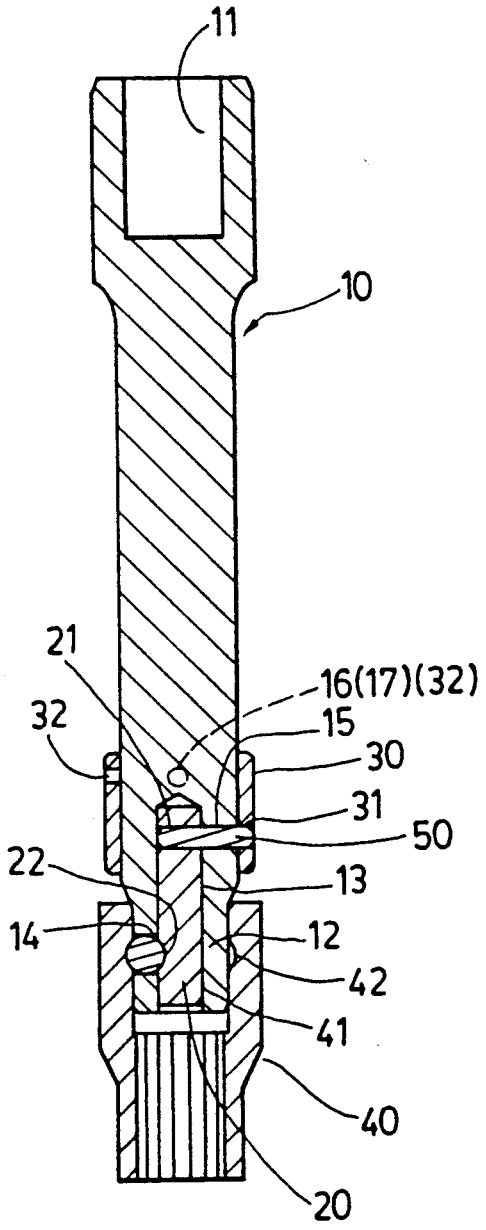
FIG. 2 is a longitudinal section showing the retainer apparatus of this invention.
Figure 3:
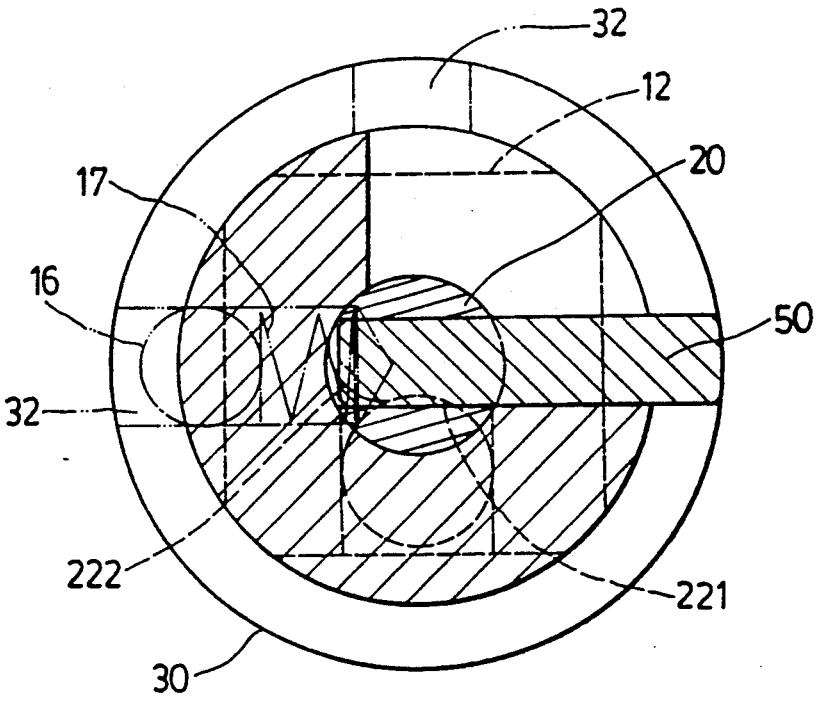
FIG. 3 is a cross-sectional view showing the retainer apparatus of this invention.
Figure 4:
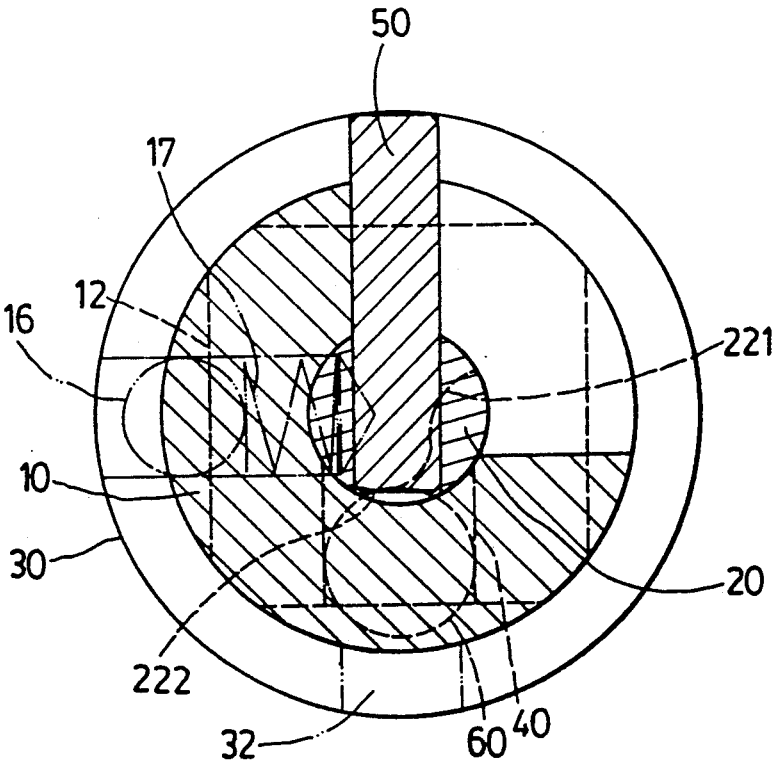
FIG. 4 is a schematic cross-sectional view illustrating the operation of the retainer apparatus according to this invention.

Referring to FIGS. 1 and 2, a retainer apparatus for a wrench unit includes a connecting rod 10, a control rod 20, a sleeving ring 30 and a socket wrench member 40.

Figure 5:
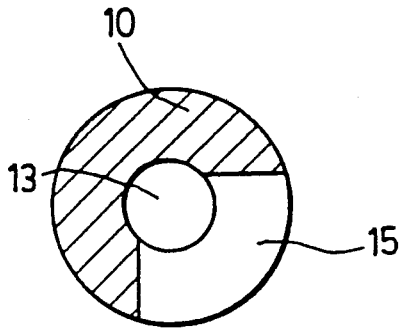
FIG. 5 is a sectional view taken along Line V—V in FIG. 1.

The connecting rod 10 has a socket portion at the upper end thereof with a recess 11 of a square cross-section with which the plug la of the driving head 1 of a rotary lever is well-matched, a plug portion 12 of a generally square cross-section at the lower end of the connecting rod 10 and engaged within the socket 41 of a socket wrench member 40, and an intermediate portion interconnecting the socket portion and the plug portion 12. The socket 41 of the socket wrench member 40 has a recess of a square cross-section which is defined by four inner surfaces in each of which a retaining hole 42 is formed. A bore 13 is formed in the lower end surface of the plug portion 12 and extends in the direction of the longitudinal axis of the connecting rod through the plug portion 12 and into the intermediate portion. A retaining hole 14 is formed through the side wall of the plug portion 12 in communication with the bore 13. A partially circumferentially extending position limiting hole 15 (see FIG. 5) is formed through the side wall of the intermediate portion in communication with the bore 13 and has two ends which are angularly spaced apart from each other at an angle of 90 degrees. A positioning ball 16 is received within a first positioning hole which is formed in the outer surface of the intermediate portion. A spring 17 is also received within the first positioning hole so as to bias the positioning ball 16 to move outward.

Figure 6:
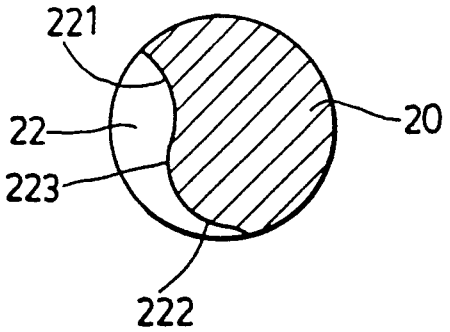
FIG. 6 is a sectional view taken along Line VI—VI in FIG. 1.

The control rod 20 is disposed rotatably within the bore 13 of the connecting rod and has a pin hole 21 formed through the upper portion thereof. A partially circumferentially extending retaining groove 22 is formed in the outer surface of the lower portion of the control rod 20. Referring to FIG. 6, the retaining groove 22 has a deep end portion 221, a narrow end portion 222 and a curved intermediate portion 223 interconnecting the deep end portion 221 and the narrow end portion 222 and gradually deepened from the narrow end portion 222 to the deep end portion 221.

A retaining ball 60 is positioned in the narrow end 222 of the retaining groove 22 of the control rod 20 and extends through the retaining hole 14 of the connecting rod 10 and into one of the retaining holes 42 of socket wrench member 40, so as to retain the socket wrench member 40 on the connecting rod 10. The retaining ball 60 has a diameter greater than that of the retaining hole 14 of the connecting rod 10, so as to confine the retaining ball 60 in the retaining groove 22 of the control rod 20 and the retaining hole 14 of the connecting rod 10.

The sleeving ring 30 is rotatably mounted on the intermediate portion of the connecting rod 10 and has a pin hole 31 formed through the side wall thereof in alignment with the pin hole 21 of the control rod 20, and two second positioning holes 32 formed through the side wall of the sleeving ring 30. The second positioning holes 32 are angularly spaced apart from each other at an angle of 90 degrees. The spring-biased positioning ball 16 extends partially into one of the second positioning holes 32, so as to position the sleeving ring 30 on the connecting rod 10.

A retaining pin 50 extends through the pin hole 31 of the sleeving ring 30, the position limiting hole 15 of the connecting rod 10 and the pin hole 21 of the control hole 20, so as to interlock the sleeving ring 30 and the control rod 20 while permitting rotation of the sleeving ring 30 and the control rod 20 relative to the connecting rod 10. When the sleeving ring 30 and control rod 20 are rotated an angle of 90 degrees relative to the connecting rod 10 so as to move the retaining ball 60 from the narrow end portion 222 to the deep end portion 221 of the retaining groove 22, the socket wrench member 40 can be removed from the connecting rod 10, due to the fact that the retaining ball 60 disengages from the retaining hole 42 of the socket wrench member 40. In this way, the socket wrench member 40 may be replaced with a new socket wrench member 40 of different size.

With this invention thus explained, it is apparent that numerous modifications and variations can be made without departing from the scope and spirit of this invention. It is therefore intended that this invention be limited only as indicated in the appended claims.

I claim:

1. A retainer apparatus for retaining a socket member on a rotatable driving head, said socket member having a socket with a recess of a square cross-section defined by four inner surfaces in each of which a retaining hole is formed, said driving head including a plug of a square cross-section, said retainer apparatus comprising:

a connecting rod having a socket portion at an end thereof, a plug portion of a generally square cross-section at the other end of said connecting rod, an intermediate portion interconnecting said socket portion and said plug portion, a bore formed in an end surface of said plug portion and extending through said plug portion and into said intermediate portion, a retaining hole formed through a side wall of said plug portion in communication with said bore, and a partially circumferentially extending in the direction of a longitudinal axis of said connecting rod position limiting hole formed through a side wall of said intermediate portion in communication with said bore and having two ends angularly spaced apart from each other at an angle of 90 degrees, said socket portion having a recess of a square cross-section in which said plug of said driving head is engaged, said plug portion of said connecting rod being engaged within said socket of said socket member;

a control rod disposed rotatably within said bore of said connecting rod and having a pin hole formed through an upper portion thereof, a partially circumferentially extending retaining groove formed in an outer surface of a lower portion of said control rod, said retaining groove having a deep end portion and a narrow end portion and a deep end portion and being gradually deepened from said narrow end portion to the deep end;

a retaining ball positioned in said narrow end portion of said retaining groove of said control rod and extending through said retaining hole of said connecting rod and into one of said retaining holes of said socket member, so as to retain said socket member on said connecting rod, said retaining ball having a diameter greater than that of .said retaining hole of said connecting rod, so as to confine said retaining ball in said retaining groove of said control rod and said retaining hole of said connecting rod;

a sleeving ring rotatably mounted on said intermediate portion of said connecting rod and having a pin hole formed through a side wall thereof in alignment with said pin hole of said control rod; and a retaining pin extending through said pin hole of said sleeving ring, said position limiting hole of said connecting rod and said pin hole of said control rod, so as to interlock said sleeving ring and said control rod while permitting rotation of said sleeving ring and said control rod relative to said connecting rod;

whereby, when said sleeving ring and said control rod are rotated an angle of 90 degrees relative to said connecting rod so as to move said retaining ball from said narrow end portion to said deep end portion of said retaining groove, said socket member can be removed from said connecting rod due to the fact that said retaining ball disengages from said retaining hole of said socket member.

2. A retainer apparatus as claimed in claim 1, said connecting rod includes a first positioning hole formed in an outer surface of said intermediate portion thereof, and a spring-biased positioning ball received within said first positioning hole, said sleeving ring having two second positioning holes formed through a side wall thereof, said second positioning holes being angularly spaced apart from each other at an angle of 90 degrees, said spring-biased positioning ball extending partially into one of said second positioning holes, so as to position said sleeving ring on said connecting rod

* * * * *

UNITED STATES PATENT AND TRADEMARK OFFICE

CERTIFICATE OF CORRECTION

PATENT NO. : 5,090,275

DATED : February 25, 1992

INVENTOR(S) : Frank McCann

It is certified that error appears in the above-identified patent and that said Letters Patent is hereby corrected as shown below:

In column 3, line 40, please insert --in the direction of a longitudinal axis of the connecting rod--.

In column 3, lines 45 and 46, please delete "in the direction of the longitudinal axis of said connecting rod".

In column 4, line 42, please insert --wherein-- after the comma.

In column 4, line 52, please insert a period after "rod".

Signed and Sealed this

Sixth Day of July, 1993

Attest:

Michael K. Kirk

MICHAEL K. KIRK

Attesting Officer

Acting Commissioner of Patents and Trademarks